US009925445B2

(12) United States Patent
Su

(10) Patent No.: US 9,925,445 B2
(45) Date of Patent: Mar. 27, 2018

(54) MULTI-HEIGHT BASEBALL HITTING DEVICE

(71) Applicant: TAIWAN JOCA CORP., Taipei (TW)

(72) Inventor: Tsang-Sheng Su, Taipei (TW)

(73) Assignee: TAIWAN JOCA CORP., Taipei (TW)

( * ) Notice: Subject to any disclaimer, the term of this patent is extended or adjusted under 35 U.S.C. 154(b) by 30 days.

(21) Appl. No.: 14/712,413

(22) Filed: May 14, 2015

(65) Prior Publication Data

US 2016/0332055 A1 Nov. 17, 2016

(51) Int. Cl.
*A63B 69/00* (2006.01)

(52) U.S. Cl.
CPC ..... *A63B 69/0075* (2013.01); *A63B 69/0002* (2013.01); *A63B 2069/0008* (2013.01); *A63B 2208/12* (2013.01); *A63B 2210/50* (2013.01); *A63B 2225/093* (2013.01)

(58) Field of Classification Search
CPC ..... A63B 69/0075; A63B 69/0002; A63B 2225/093; A63B 2208/12; A63B 2210/50; A63B 2069/0008
See application file for complete search history.

(56) References Cited

U.S. PATENT DOCUMENTS 3,858,878 A * 1/1975 Tassone ..... A63B 69/0075 473/398
4,962,924 A * 10/1990 James ..... A63B 69/0075 473/417
2011/0183782 A1* 7/2011 Wang ..... A63B 69/0075 473/417

* cited by examiner

*Primary Examiner* — Gene Kim
*Assistant Examiner* — Jeffrey Vanderveen
(74) *Attorney, Agent, or Firm* — Kirton McConkie; Evan R. Witt

(57) ABSTRACT

A multi-height baseball hitting device includes a base plate assembly, a sleeve and a pipe. The sleeve is disposed on the base plate assembly. The sleeve has at least three positioning blocks extending from an inner wall of the sleeve. The pipe has a supporting portion, a connecting portion and a positioning portion. The supporting portion is connected with the connecting portion for supporting a ball. A plurality of ring-shaped rails are formed on the positioning portion and arranged from the connecting portion at equal intervals, and the positioning blocks of the sleeve are engaged with the ring-shaped rails, such that the pipe is adjustable to be fixed with plural heights, thereby meeting all of the heights of children and adults.

20 Claims, 8 Drawing Sheets

MULTI-HEIGHT BASEBALL HITTING DEVICE

FIELD OF THE INVENTION

The present invention relates to a baseball hitting device, and more particularly to a multi-height baseball hitting device.

BACKGROUND OF THE INVENTION

A baseball hitting device is used by baseball players to practice and improve their hitting skills. Various baseball hitting devices have been proposed in the past. However, most of the baseball hitting devices cannot be adjusted to meet all of the heights of children and adults. In contrast, a conventional hitting device may be only designed for adults, or for children. Meanwhile, even though some conventional hitting devices provide an adjustable stand for sustaining a baseball, the strength of the adjustable stand is not enough to bear thousands of hits.

There is a need of providing a multi-height baseball hitting device to obviate the drawbacks encountered from the prior art.

SUMMARY OF THE INVENTION

It is an object of the present invention to provide a multi-height baseball hitting device in order to overcome the above-mentioned drawbacks encountered by the prior arts.

The present invention provides a multi-height baseball hitting device. By engaging the positioning blocks of the sleeve with the ring-shaped rails, the pipe is adjustable to be fixed with plural heights, thereby meeting all of the heights of children and adults.

The present invention also provides a multi-height baseball hitting device. Since a first plate, a second plate and a third plate are assembled as a home base and the width of the first plate equals to the sum of the widths of the second plate and the third plate, the product may be simply packed, the package volume is reduced, and further the cost is also reduced.

In accordance with an aspect of the present invention, there is provided a multi-height baseball hitting device. The multi-height baseball hitting device includes a base plate assembly, a sleeve and a pipe. The sleeve is disposed on the base plate assembly. The sleeve has at least three positioning blocks extending from an inner wall of the sleeve. The pipe has a supporting portion, a connecting portion and a positioning portion. The supporting portion is connected with the connecting portion for supporting a ball. A plurality of ring-shaped rails are formed on the positioning portion and arranged from the connecting portion at equal intervals, and the positioning blocks of the sleeve are engaged with the ring-shaped rails, such that the pipe is adjustable to be fixed with plural heights.

In accordance with another aspect of the present invention, there is provided a multi-height baseball hitting device. The multi-height baseball hitting device includes a base plate assembly, a sleeve and a pipe. The base plate assembly includes a first plate, a second plate and a third plate. The first plate, the second plate and the third plate are assembled as a home base, and the width of the first plate equals to the sum of the widths of the second plate and the third plate. The sleeve is disposed on the base plate assembly. The sleeve has at least three positioning blocks extending from an inner wall of the sleeve. The pipe has a supporting portion, a connecting portion and a positioning portion. The supporting portion is connected with the connecting portion for supporting a ball. A plurality of ring-shaped rails are formed on the positioning portion and arranged from the connecting portion at equal intervals, and the positioning blocks of the sleeve are engaged with the ring-shaped rails, such that the pipe is adjustable to be fixed with plural heights.

The above contents of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1:
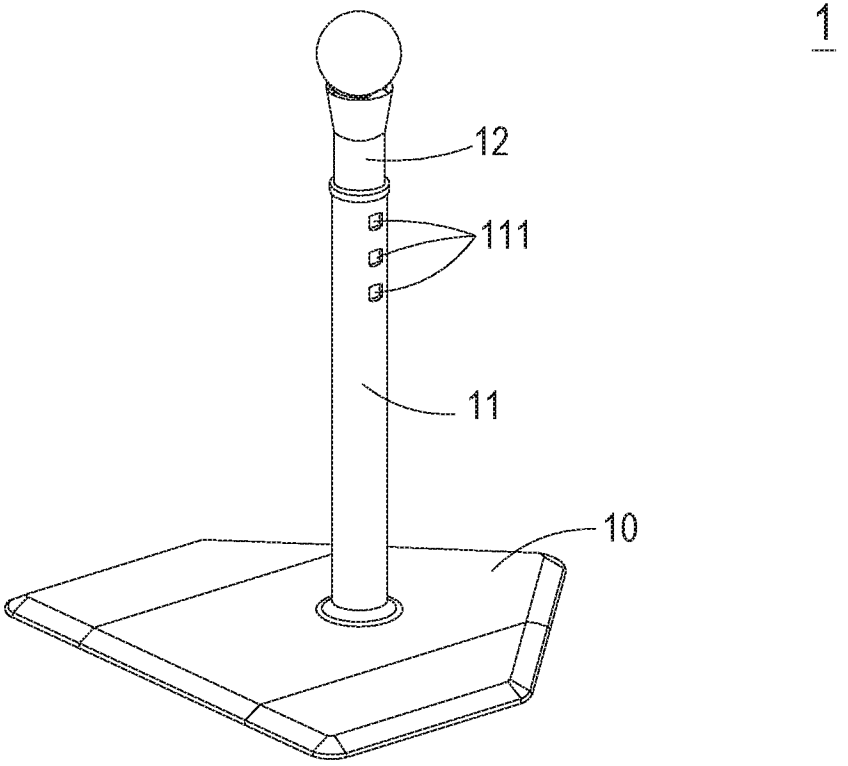
FIG. 1 schematically illustrates the structure of a multi-height baseball hitting device according to an embodiment of the present invention.
Figure 2:
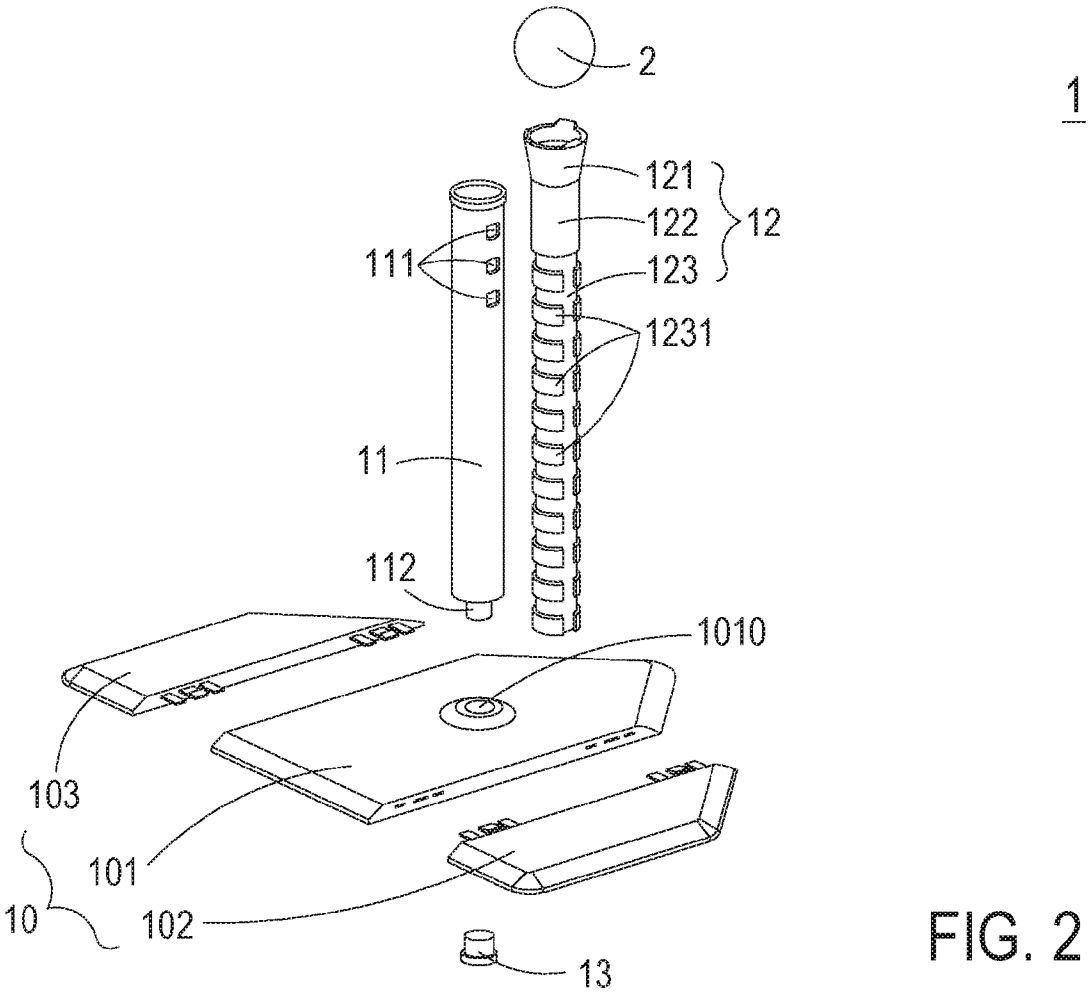
FIG. 2 schematically illustrates the exploded view of a multi-height baseball hitting device according to an embodiment of the present invention.

Please refer to FIG. 1 and FIG. 2. FIG. 1 schematically illustrates the structure of a multi-height baseball hitting device according to an embodiment of the present invention. FIG. 2 schematically illustrates the exploded view of a multi-height baseball hitting device according to an embodiment of the present invention. As shown in FIG. 1 and FIG. 2, a multi-height baseball hitting device 1 includes a base plate assembly 10, a sleeve 11 and a pipe 12. The sleeve 11 is disposed on the base plate assembly 10. The sleeve 11 has at least three positioning blocks 111 extending from an inner wall of the sleeve 11. The pipe 12 has a supporting portion 121, a connecting portion 122 and a positioning portion 123. The supporting portion 121 is connected with the connecting portion 122 for supporting a ball. For example, the supporting portion 122 is a supportive cup matched with a baseball 2, but not limited herein. A plurality of ring-shaped rails 1231 are formed on the positioning portion 123 and arranged from the connecting portion 122 at equal intervals, and the positioning blocks 111 of the sleeve 11 are engaged with the ring-shaped rails 1231, such that the pipe 12 is adjustable to be fixed with plural heights. By engaging the positioning blocks 111 of the sleeve 11 with the ring-shaped rails 1231, the pipe 12 is adjustable to be fixed with plural heights, thereby meeting all of the heights of children and adults.

In some embodiments, the base plate assembly 10 includes a first plate 101, a second plate 102 and a third plate 103. The first plate 101, the second plate 102 and the third plate 103 are assembled as a home base (i.e. a home plate). The sleeve 11 further includes a protruded portion 112 extending from the bottom of the sleeve 11, and the protruded portion 112 is penetrated through an opening 1010 of the first plate 101, among which the protruded portion 112 is preferably a screw portion. In order to increase the strength of the structure, the multi-height baseball hitting device 1 further includes a fastening element 13. The fastening element 13 is fixed with the protruded portion 112 of the sleeve 11 from the opposite side of the base plate assembly 10. By the fixing of the fastening element 13 and the protruded portion 112 and the engagement of the positioning blocks 111 and the ring-shaped rails 1231, the strength of the structure of the multi-height baseball hitting device 1 of the present invention may bear over thousands of hits.

Figure 3:
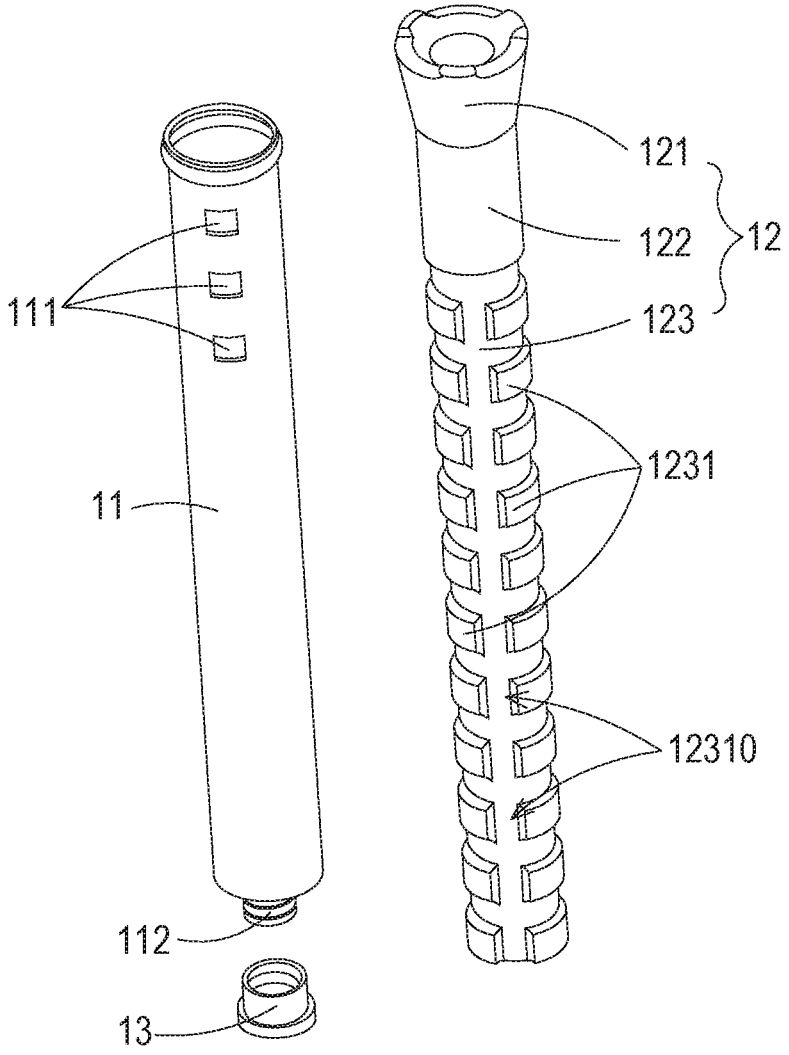
FIG. 3 schematically illustrates the detailed structures of a sleeve, a pipe and a fastening element of a multi-height baseball hitting device according to an embodiment of the present invention.
Figure 4:
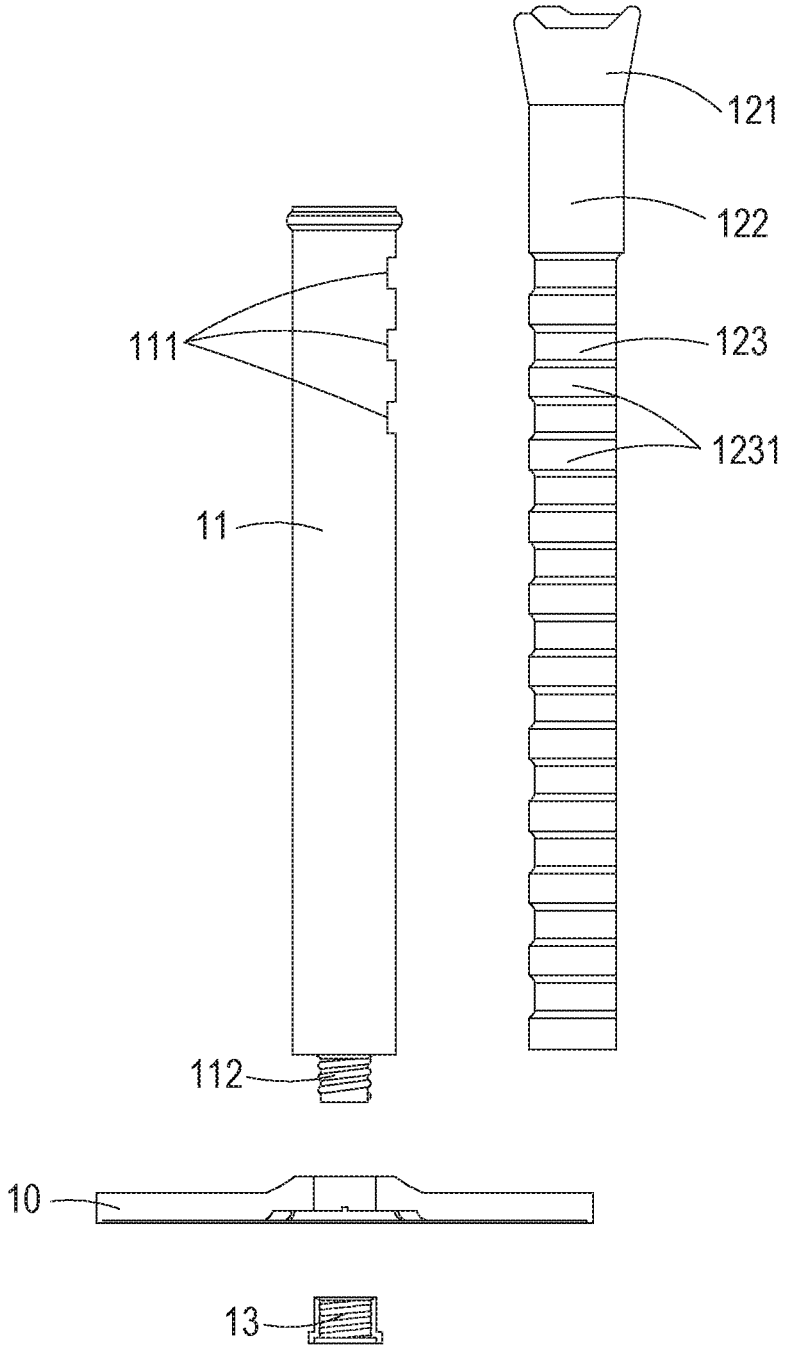
FIG. 4 schematically illustrates the left view of a sleeve, a pipe, a fastening element and a base plate assembly of a multi-height baseball hitting device according to an embodiment of the present invention.
Figure 5:
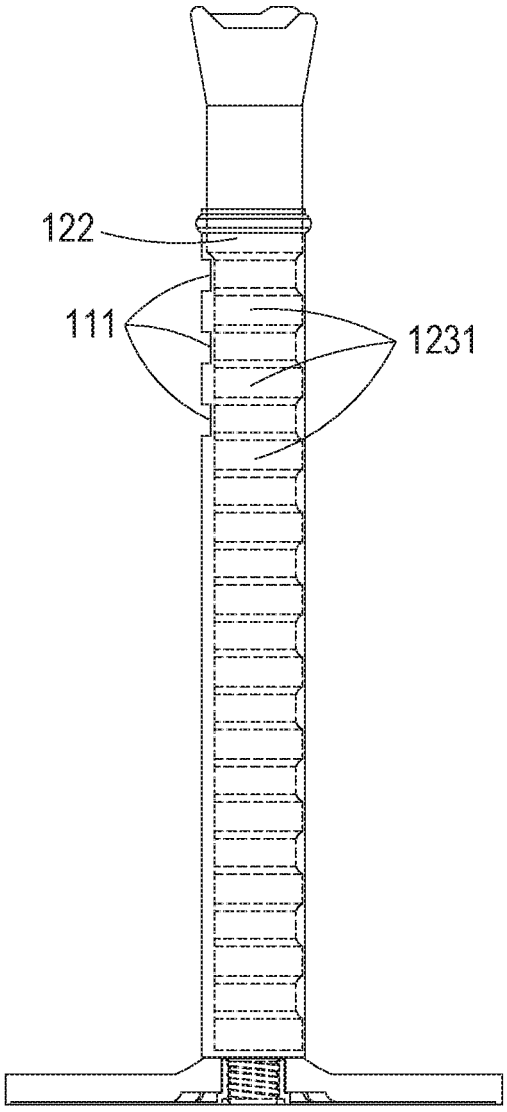
FIG. 5 schematically illustrates the left view of the multi-height baseball hitting device combined by the sleeve, the pipe, the fastening element and the base plate assembly shown in FIG. 4.

Please refer to FIG. 3, FIG. 4 and FIG. 5. FIG. 3 schematically illustrates the detailed structures of a sleeve, a pipe and a fastening element of a multi-height baseball hitting device according to an embodiment of the present invention. FIG. 4 schematically illustrates the left view of a sleeve, a pipe, a fastening element and a base plate assembly of a multi-height baseball hitting device according to an embodiment of the present invention. FIG. 5 schematically illustrates the left view of the multi-height baseball hitting device combined by the sleeve, the pipe, the fastening element and the base plate assembly shown in FIG. 4. As shown in FIG. 3, FIG. 4 and FIG. 5, the sleeve 11 of the multi-height baseball hitting device 1 is adjustable for being at least partially sleeved around the positioning portion 123 of the pipe 12 or being sleeved around the positioning portion 123 and part of the connecting portion 122. For example, the amount of the positioning blocks 111 is three, and the amount of the ring-shaped rails 1231 is eleven. The three positioning blocks 111 are selectively accommodated within three of the intervals between the connecting portion 122 and the top one of the ring-shaped rail 1231 and between the ring-shaped rails 1231, and the pipe 2 is adjustable to be fixed with nine heights.

In some embodiments, each of the ring-shaped rails 1231 can further have a groove 12310. The grooves 12310 are matched with the positioning blocks 111, so that the positioning blocks 111 can be passed through the groove 12310 in an effortless manner. Particularly, when the pipe 12 is inserted into the sleeve 11, the pipe 12 may be rotated for aligning the positioning blocks 111 with the grooves 12310, so that the positioning blocks 111 can be simply passed through the groove 12310. After the pipe 12 is inserted into the sleeve with a specific height, the pipe 12 may be rotated again for engaging the positioning blocks 111 with the ring-shaped rails 1231, such that the pipe 12 is adjustable to be fixed with plural heights.

Figure 6:
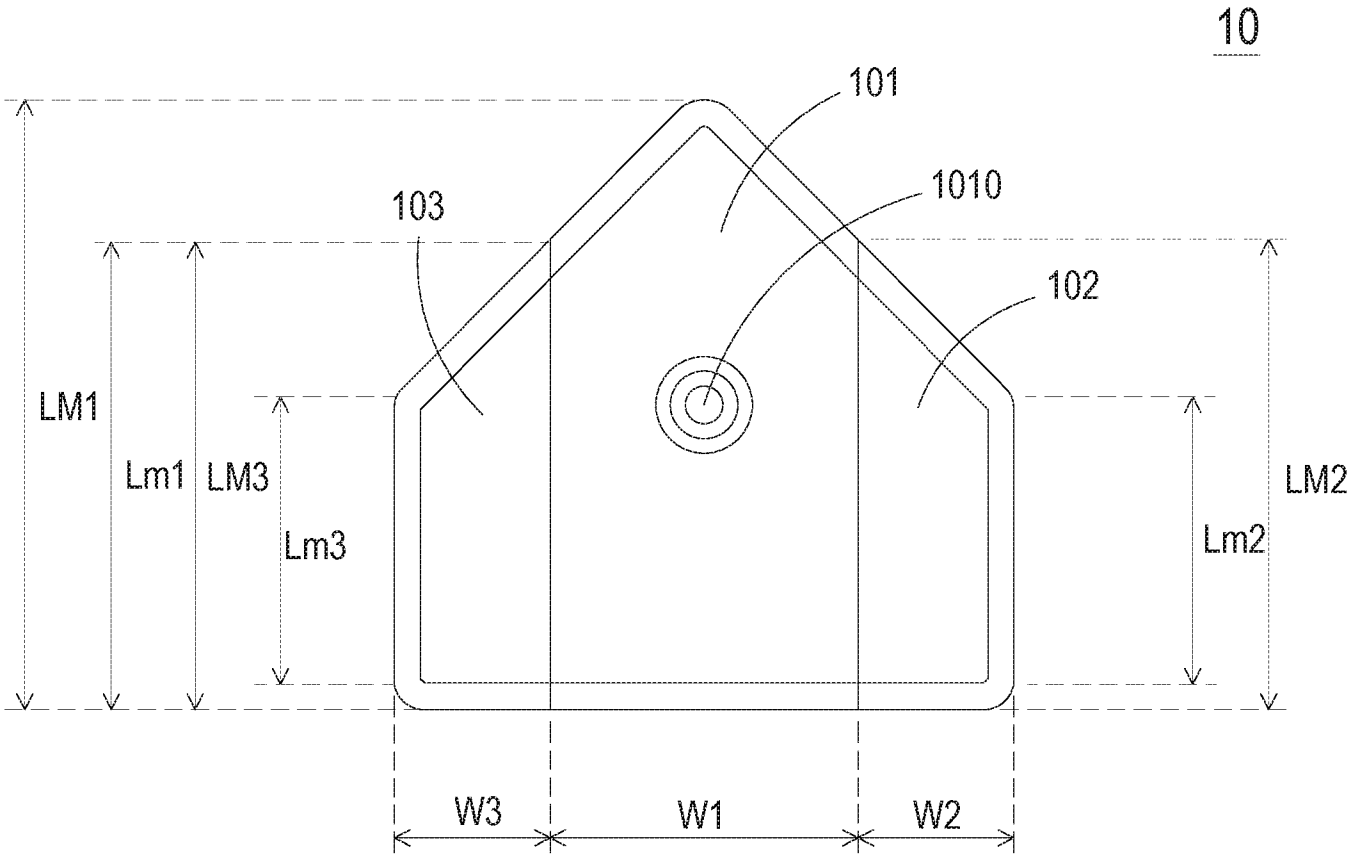
FIG. 6 schematically illustrates the top view of a base plate assembly of a multi-height baseball hitting device according to an embodiment of the present invention.
Figure 7:
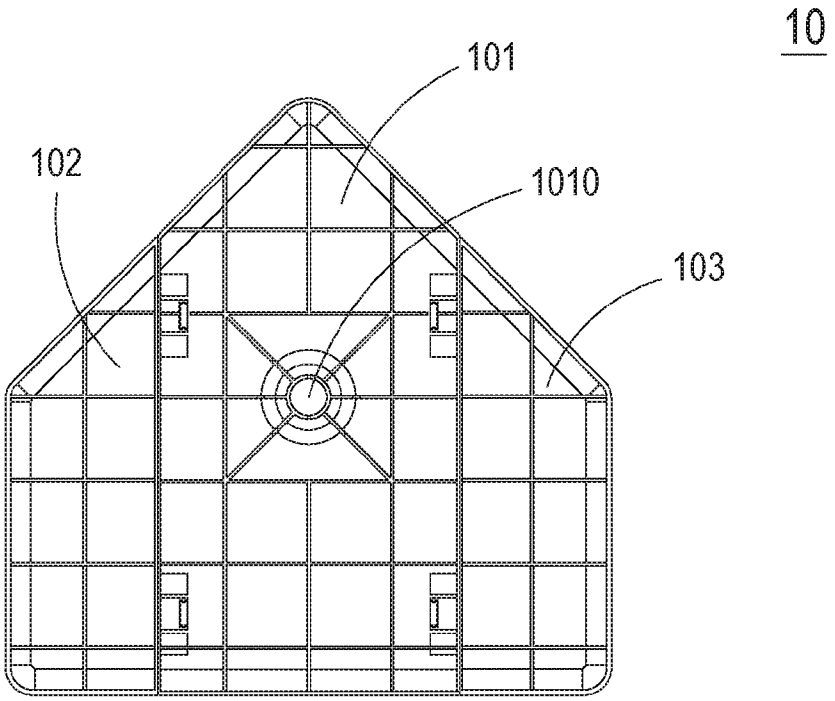
FIG. 7 schematically illustrates the bottom view of a base plate assembly of a multi-height baseball hitting device according to an embodiment of the present invention.
Figure 8:
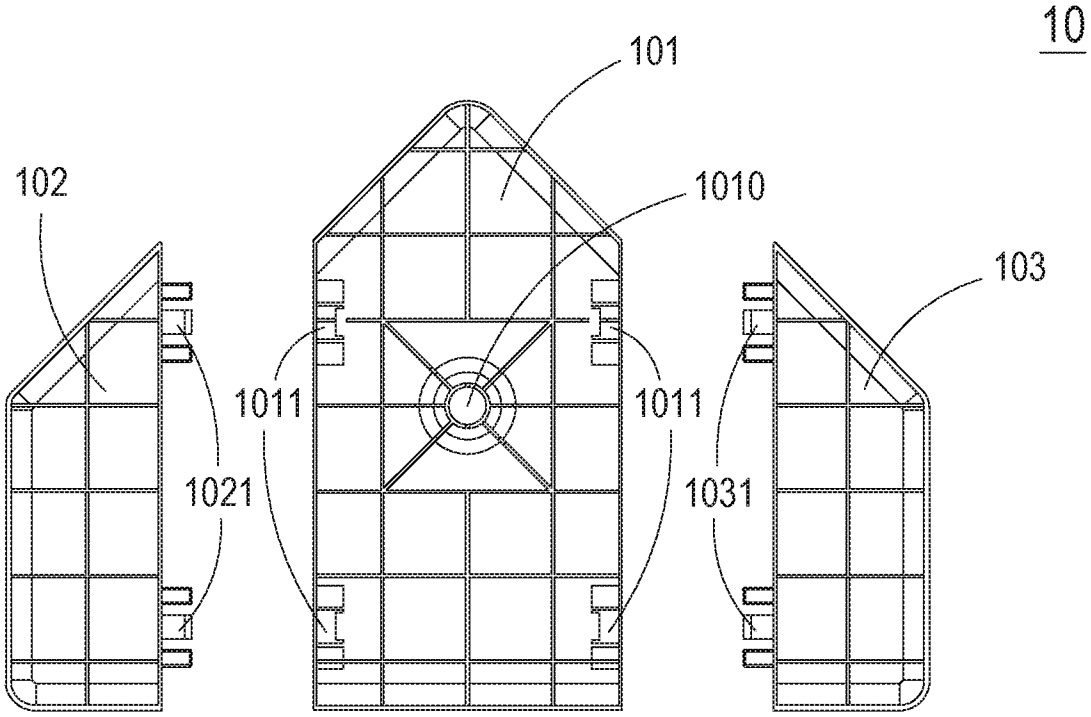
FIG. 8 schematically illustrates the bottom view of a first plate, a second plate and a third plate of the base plate assembly shown in FIG. 7.

Please refer to FIG. 6, FIG. 7 and FIG. 8. FIG. 6 schematically illustrates the top view of a base plate assembly of a multi-height baseball hitting device according to an embodiment of the present invention. FIG. 7 schematically illustrates the bottom view of a base plate assembly of a multi-height baseball hitting device according to an embodiment of the present invention. FIG. 8 schematically illustrates the bottom view of a first plate, a second plate and a third plate of the base plate assembly shown in FIG. 7. As shown in FIG. 6 through FIG. 8, the base plate assembly 10 includes a first plate 101, a second plate 102 and a third plate 103. The first plate 101 has four first fixing elements 1011, the second plate 102 has two second fixing elements 1021, the third plate 103 has two third fixing elements 1031, the second fixing elements 1021 are latched with two of the first fixing elements 1011, and the third fixing elements 1031 are latched with the rest two of the first fixing elements 1011. In some embodiments, the width W1 of the first plate 101 equals to the sum of the width W2 of the second plate 102 and the width W3 of the third plate 103 (i.e. W1=W2+W3). Since a first plate 101, a second plate 102 and a third plate 103 are assembled as a home base and the width of the first plate 101 equals to the sum of the widths of the second plate 102 and the third plate 103, the product may be simply packed, the package volume is reduced, and further the cost is also reduced.

In some embodiments, the first plate 101 has a maximum length LM1 and a minimum length Lm1. The maximum length LM1 is a central length of the first plate 101 and the minimum length Lm1 is a length lateral to the central length. The maximum length LM1 is greater than the minimum length Lm1. The second plate 102 has a maximum length LM2 and a minimum length Lm2. The maximum length LM2 is greater than the minimum length Lm2. The third plate 103 has a maximum length LM3 and a minimum length Lm3. The maximum length LM3 is greater than the minimum length Lm3. The maximum length LM2 of the second plate 102 is substantially equal to the minimum length Lm1 of the first plate 101. The maximum length LM3 of the third plate 103 is substantially equal to the minimum length Lm1 of the first plate 101. The range of the lengths of the first plate 101 is between the maximum LM1 and the minimum Lm1. The range of the lengths of the second plate 102 is between the maximum LM2 and the minimum Lm2. The range of the lengths of the third plate 103 is between the maximum LM3 and the minimum Lm3. Again, the product may be simply packed, the package volume is reduced, and further the cost is also reduced due to the features of the assembly of the first plate 101, the second plate 102 and the third plate 103.

From the above description, the present invention provides a multi-height baseball hitting device. By engaging the positioning blocks of the sleeve with the ring-shaped rails, the pipe is adjustable to be fixed with plural heights, thereby meeting all of the heights of children and adults. Meanwhile, since a first plate, a second plate and a third plate are assembled as a home base and the width of the first plate equals to the sum of the widths of the second plate and the third plate, the product may be simply packed, the package volume is reduced, and further the cost is also reduced.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A multi-height baseball hitting device, comprising:

a base plate assembly comprising a first plate, a second plate and a third plate, wherein the first plate, the second plate and the third plate are assembled as a home base, wherein the first plate has four first fixing elements, the second plate has two second fixing elements, and the third plate has two third fixing elements, wherein the second fixing elements are latched with two of the first fixing elements, and the third fixing elements are latched with the rest two of the first fixing elements, wherein the width of the first plate equals to the sum of the widths of the second plate and the third plate, and wherein the second plate and the third plate are symmetric with each other, wherein a side of the first plate immediately adjacent the second plate has a length substantially equal to a side of the second plate immediately adjacent the first plate, and wherein a side of the first plate immediately adjacent the third plate has a length substantially equal to a side of the third plate immediately adjacent the first plate;

a sleeve disposed on the base plate assembly, wherein the sleeve has at least three positioning blocks extending from an inner wall of the sleeve; and a pipe having a supporting portion, a connecting portion and a positioning portion, wherein the supporting portion is connected with the connecting portion for supporting a ball, wherein a plurality of ring-shaped rails are formed on the positioning portion and arranged from the connecting portion at equal intervals, each of the ring-shaped rails having a groove interrupting the rail, and the grooves of the various rails being substantially aligned along the positioning portion to permit passage of the positioning blocks therethrough as a height of the pipe within the sleeve is adjusted, and the positioning blocks of the sleeve are engaged with the ring-shaped rails and at least one of the ring-shaped rails is disposed between two adjacent positioning blocks of the positioning blocks, such that the pipe is adjustable to be fixed with plural heights.

2. The multi-height baseball hitting device according to claim 1, wherein the sleeve is adjustable for being at least partially sleeved around the positioning portion of the pipe or being sleeved around the positioning portion and part of the connecting portion.

3. The multi-height baseball hitting device according to claim 1, wherein the supporting portion is a supportive cup matched with a baseball.

4. The multi-height baseball hitting device according to claim 1, wherein the sleeve further has a protruded portion extending from the bottom of the sleeve, and the protruded portion is penetrated through an opening of the first plate.

5. The multi-height baseball hitting device according to claim 4, wherein the protruded portion is a screw portion.

6. The multi-height baseball hitting device according to claim 5 further comprising a fastening element, wherein the fastening element is fixed with the protruded portion of the sleeve from the opposite side of the base plate assembly.

7. The multi-height baseball hitting device according to claim 1, wherein the amount of the positioning blocks is three, and the amount of the ring-shaped rails is eleven.

8. The multi-height baseball hitting device according to claim 7, wherein the positioning blocks are selectively accommodated within three of the intervals between the connecting portion and the ring-shaped rail and between the ring-shaped rails, and the pipe is adjustable to be fixed with nine heights.

9. The multi-height baseball hitting device according to claim 7, wherein the positioning blocks are selectively accommodated within three intervals between the connecting portion and the ring-shaped rail and between the ring-shaped rails, and the pipe is adjustable to be fixed at any of nine predefined heights.

10. The multi-height baseball hitting device according to claim 1, wherein a number of the positioning blocks is three, and a number of the ring-shaped rails is eleven.

11. The multi-height baseball hitting device according to claim 1, wherein the grooves of the ring-shaped rails are matched with the positioning blocks of the sleeve.

12. A multi-height baseball hitting device, comprising:

a base plate assembly comprising a first plate, a second plate and a third plate, wherein the first plate, the second plate and the third plate are assembled as a home base, wherein the first plate has four first fixing elements, the second plate has two second fixing elements, and the third plate has two third fixing elements, wherein the second fixing elements are latched with two of the first fixing elements, and the third fixing elements are latched with the rest two of the first fixing elements, wherein the width of the first plate equals to the sum of the widths of the second plate and the third plate, and wherein the second plate and the third plate are symmetric with each other, wherein a side of the first plate immediately adjacent the second plate has a length substantially equal to a side of the second plate immediately adjacent the first plate, and wherein a side of the first plate immediately adjacent the third plate has a length substantially equal to a side of the third plate immediately adjacent the first plate;

a sleeve disposed on the base plate assembly, wherein the sleeve has at least three positioning blocks extending from an inner wall of the sleeve; and a pipe having a supporting portion, a connecting portion and a positioning portion, wherein the supporting portion is connected with the connecting portion for supporting a ball, wherein a plurality of ring-shaped rails are formed on the positioning portion and arranged from the connecting portion at equal intervals, each of the ring-shaped rails having a groove interrupting the rail, and the grooves of the various rails being substantially aligned along the positioning portion to permit passage of the positioning blocks therethrough as a height of the pipe within the sleeve is adjusted, and the positioning blocks of the sleeve are engaged with the ring-shaped rails and at least one of the ring-shaped rails is disposed between two adjacent positioning blocks of the positioning blocks, such that the pipe is adjustable to be fixed with plural heights.

13. A multi-height baseball hitting device, comprising:

a base plate assembly;

a sleeve disposed on the base plate assembly, wherein the sleeve has at least three positioning blocks extending from an inner wall of the sleeve; and a pipe disposable within the sleeve, the pipe comprising:

a supporting portion for supporting a ball;

a connecting portion extending from the supporting portion;

a positioning portion extending from the connecting portion opposite the supporting portion; and a plurality of equally spaced circumferential ring-shaped rails extending outwardly from the positioning portion, each of the plurality of rails comprising a groove adapted to permit substantially free passage of the positioning blocks past the rails during height adjustment of the pipe within the sleeve, whereby when the positioning blocks are disposed between adjacent rails the pipe may be rotated within the sleeve so that at least one of the positioning blocks engages with and supports at least one of the rails, thereby fixing the height of the pipe within the sleeve at one of a plurality of predefined heights.

14. The multi-height baseball hitting device according to claim 13, wherein the positioning blocks are equally spaced and are disposed in a line vertically within the sleeve.

15. The multi-height baseball hitting device according to claim 13, wherein the grooves of the plurality of rails are aligned forming a line of grooves extending along the positioning portion.

16. The multi-height baseball hitting device according to claim 13, wherein the sleeve is adjustable for being at least partially sleeved around the positioning portion of the pipe or being sleeved around the positioning portion and part of the connecting portion.

17. The multi-height baseball hitting device according to claim 13, wherein the supporting portion is a supportive cup matched with a baseball.

18. The multi-height baseball hitting device according to claim 13, wherein the base plate assembly comprises a first plate, a second plate and a third plate, wherein the first plate, the second plate and the third plate are assembled as a home base, wherein the width of the first plate equals to the sum of the widths of the second plate and the third plate, and wherein the second plate and the third plate are symmetric with each other.

19. The multi-height baseball hitting device according to claim 18, wherein a side of the first plate immediately adjacent the second plate has a length substantially equal to a side of the second plate immediately adjacent the first plate, and wherein a side of the first plate immediately adjacent the third plate has a length substantially equal to a side of the third plate immediately adjacent the first plate.

20. The multi-height baseball hitting device according to claim 19, wherein the sleeve further has a protruded portion extending from the bottom of the sleeve, and the protruded portion is penetrated through an opening of the first plate.

* * * * *